US005537771A

United States Patent [19]

Martin

[11] Patent Number: 5,537,771

[45] Date of Patent: Jul. 23, 1996

[54] MEANS FOR REDUCING THE CRIMINAL USEFULNESS OF DISCHARGEABLE HAND WEAPONS

[76] Inventor: John M. Martin, 15 Charing Cross, Brownsville, Tex. 78521

[21] Appl. No.: 489,487

[22] Filed: Jun. 12, 1995

Related U.S. Application Data

[60] Division of Ser. No. 939,914, Sep. 3, 1992, Pat. No. 5,423,143, which is a continuation-in-part of Ser. No. 553,555, Jul. 18, 1990, Pat. No. 5,192,818, which is a continuation-in-part of Ser. No. 188,646, May 2, 1988, abandoned, which is a continuation-in-part of Ser. No. 880,095, Jun. 10, 1987, abandoned, which is a continuation-in-part of Ser. No. 589,773, Mar. 15, 1984, abandoned.

[51] Int. Cl.[6] ..... F41A 17/06

[52] U.S. Cl. ..... 42/70.010; 42/70.090; 42/70.060

[58] Field of Search ..... 42/66, 70.01, 70.06, 42/70.07, 70.08, 70.09, 70.11; 89/134

[56] References Cited

U.S. PATENT DOCUMENTS 953,279 3/1910 Moore ..... 42/70.01

4,563,827 1/1986 Heltzel ..... 42/70.01

*Primary Examiner*—Stephen C. Bentley

[57] ABSTRACT

An apparatus that limits the amount of time that a hand weapon can be discharged during use, an apparatus for preventing the discharging of a hand weapon based on the weapon having been in an attitude that is good for concealed carrying, an apparatus for preventing the discharging of a hand weapon that has had a part not necessary for the discharging of the weapon removed to increase concealability, an apparatus that transmits an identifying signal from a hand weapon under various conditions, a means necessary for the firing of a hand weapon that provides a detectable magnetic field in the vicinity of the hand weapon, and an apparatus for preventing the discharging of a hand weapon based on conditions (e.g. a signal or a magnetic field) that can be created in a location where the weapon is likely to be used for criminal purposes.

9 Claims, 6 Drawing Sheets

MEANS FOR REDUCING THE CRIMINAL USEFULNESS OF DISCHARGEABLE HAND WEAPONS

CROSS REFERENCE TO RELATED APPLICATION

This application is a divisional application of Ser. No. 939,914, now U.S. Pat. No. 5,423,143 filed Sep. 3, 1992 which was a continuation-in-part application of Ser. No. 553,555, now U.S. Pat. No. 5,192,818 filed Jul. 18, 1990 which was a continuation-in-part application of application Ser. No. 188,646 filed May 2, 1988 and now abandoned which was a continuation-in-part application of application Ser. No. 880,095 filed Jun. 10, 1987 and now abandoned which was a continuation-in-part application of application Ser. No. 589,773 filed Mar. 15, 1984 and now abandoned.

BACKGROUND OF THE INVENTION

1. Field of the Invention.

This invention relates to dischargeable hand weapons and in particular to methods and apparatuses for reducing the criminal usefulness of such weapons.

2. Description of Related Art.

Dischargeable hand weapons are popular for defense of persons but unfortunately they are also useful for committing many crimes. Reducing the criminal usefulness of those weapons would save many lives and prevent much crime.

U.S. Pat. No. 3,400,383 discloses an apparatus having a means for receiving a directional electromagnetic signal and a means for preventing the discharging of a weapon based on the reception of the signal.

There is at least one safety device for preventing the discharging of a hand weapon if its angle of discharging is within a certain range.

SUMMARY OF THE INVENTION

There are several ways of reducing the usefulness of a hand weapon for crimes. One way is by limiting its area of usefulness. Accordingly, one object of this invention is to provide methods and means for preventing the discharging a hand weapon in locations relatively distant from where the weapon is kept: more specifically, to provide a method for limiting the amount of time that the weapon may be discharged after there is a change of location of the weapon.

Limiting the discharging of a hand weapon that has been carried concealed by a person will reduce the criminal usefulness of the weapon. Accordingly, another object of this invention is to provide an apparatus for preventing the discharging of a hand weapon based on the weapon having been in an attitude that is good for concealed carrying.

Preventing the discharging of a hand weapon that has had a part not necessary for the discharging of the weapon removed to increase concealability will reduce the criminal usefulness of the weapon. Accordingly, another object of this invention is to provide an apparatus for preventing the discharging of a hand weapon that has had a part not necessary for the discharging of the weapon removed to increase concealability.

Reducing the effectiveness of visual concealment of a hand weapon will reduce the criminal usefulness of the weapon. Accordingly, another object of this invention is to provide a means for disclosing the presence of a hand weapon concealed from view; more specifically, to provide an apparatus that transmits an identifying signal from a hand weapon under various conditions and to provide a means necessary for the firing of a hand weapon that provides a detectable magnetic field in the vicinity of the hand weapon.

Preventing the discharging of a hand weapon in business locations such as stores and banks will reduce the criminal usefulness of the weapon. Accordingly, another object of this invention is to provide an apparatus for preventing the discharging of a hand weapon based on conditions such as a signal or a magnetic field that can be created in a location where the weapon is likely to be used for criminal purposes.

Further objects and advantages of this invention will be apparent from a consideration of the drawings and descriptions herein.

BRIEF DESCRIPTION OF THE DRAWINGS

Drawings are not to scale and some obviously necessary parts may be omitted, e.g. ground wires, or modified in shape in order to allow for clearer illustration of other parts.

FIG. 101 further illustrates the handgun of FIG. 9.

DETAILED DESCRIPTION

In this application hand weapon means a weapon which discharges, has a civilian defensive use, is primarily designed for use against living things when used offensively or defensively and is designed to be either partly or totally hand supported during use. Hand weapons include such things as handguns, rifles, shotguns, tear gas sprayers, electric shocking devices and small hand held rocket launchers such as the Gyro-Jet.

In this application criminal usefulness of a hand weapon refers to the usefulness of a hand weapon for illegal acts where a person willfully threatens or injures another person with the weapon.

Figure 1:
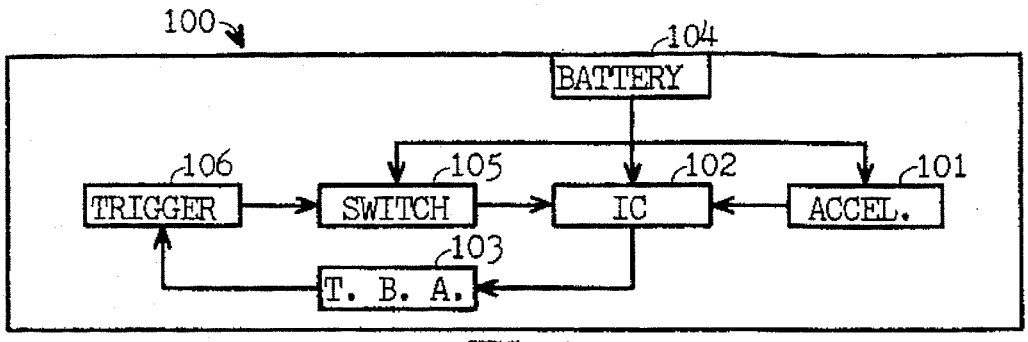
FIG. 1 is a block diagram of a handgun having electronic parts.
Figure 2:
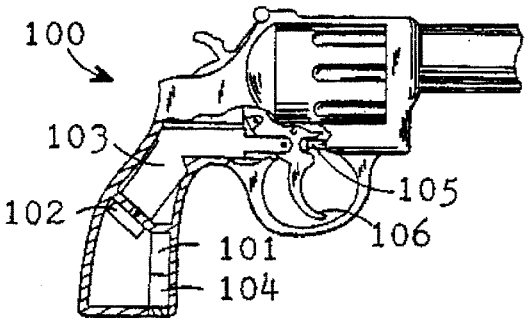
FIG. 2 further illustrates the handgun of FIG. 1.

FIGS. 1 and 2 illustrate a handgun 100 having an accelerometer 101 that is capable of sensing the accelerations that occur when a person changes the location of the handgun 100, but is not capable of sensing accelerations from usual everyday environmental vibrations that occur while the handgun 100 is not being used, e.g., a capability of sensing more than 0.01 g at frequencies of less than 5 Hz.

When the accelerometer 101 senses accelerations of the handgun 100 as its location is changed by being picked up, carried, aimed, etc., it sends that information to an IC 102 which has timing and other circuitry. This IC 102 as well as the other ICs of this application can be made by a custom IC manufacturer having the capability of making ICs based on functional descriptions such as those contained herein. Electronic Engineer's Master Catalog, Electronic Buyer's News Handbook and Directory, IC Master, and Electronic Buyer's Guide are directories that contain listings of such manufacturers.

The IC 102 has an output that goes to a trigger blocking apparatus 103 which only permits firing when receiving power from the IC 102. A battery 104 constantly supplies power to the accelerometer 101, the IC 102, and a normally open switch 105 which is controlled by the handgun's trigger 106.

The triggers and trigger blocking apparatuses of the electronic handweapons of this application are the same as parts 60 through 70 of U.S. Pat. No. 4,488,370 and the switches of the electronic hand weapons of this application are the same as part 17 of that same patent.

In this handgun 100 and in any other hand weapon described hereinafter having a trigger blocking apparatus, there is potting of wiring and other electronic parts, and/or the trigger blocking apparatus 103 and the part of the trigger 106 in contact with the trigger blocking apparatus 103 are enclosed in a part of the weapon which has been welded shut, and/or are enclosed in the weapon behind a lockable and unlockable part for accessing the trigger blocking apparatus 103. Potting and welding serve as a means for preventing the trigger blocking apparatus 103 from being accessed without causing damage to a part of the resulting assembly. Use of a lockable and unlockable part permits legal repairs and maintenance on the enclosed parts without damage to the weapon in a jurisdiction having a legal restriction on accessibility of the parts.

The handgun 100 is designed for defensive use in homes and businesses. Except for the electronic parts and the mechanical parts of the trigger blocking apparatus 103, it is essentially a revolver of conventional design.

Slightly pulling the trigger 106 for firing closes the switch 105. This sends power to a part of the IC 102 that allows the power to go to the trigger blocking apparatus 103 if there has been an at least 24 hour period during which there was no sensing of acceleration of the handgun 100 and it has been less than ten minutes since there was a sensing of acceleration ending the at least 24 hour period. This allows firing. If the time conditions have not been fulfilled, power will not be sent to the trigger blocking apparatus 103 and the apparatus 103 will prevent firing of the handgun 100.

In the electronic hand weapons of this application each trigger blocking apparatus prevents firing when not receiving power by blocking complete trigger movement and allows firing when receiving power by not blocking any trigger movement. Thus, in this handgun 100 after the trigger blocking apparatus 103 begins receiving power, firing can be accomplished by a continuation of trigger pull. Because the handgun's electronic processing is so fast, firing of the handgun 100 can be made to feel no different than firing a conventional weapon.

In order for the handgun 100 to be fired, its accelerometer 101 must not sense an acceleration for an at least 24 hour period. After completing the minimum period, it can be fired during the 10 minute period immediately following the sensing of an acceleration, e.g. from movement that occurs when it is picked up for firing. After the 10 minute limit for firing is over, the handgun 100 can no longer be fired until it again fulfills the conditions required for firing. In addition, since all of its electronic parts depend on adequate battery power for operation, the handgun 100 cannot be fired unless it has had a good battery 104 in it for at least 24 hours.

Thus, in the operation of the handgun 100 the accelerometer 101 functions as a means for determining if an act has occurred relating to changing the location of the handgun 100. In this case the act is one acceleration of the handgun 100 capable of being sensed by the accelerometer 101. Further, the IC 102 functions as a means for determining that for a certain minimum time period there has been no determining that such an act has occurred. Finally, the IC 102 along with the trigger blocking apparatus 103 function as a means for preventing firing of the handgun 100 and also for allowing firing of the handgun 100 for a certain maximum time period.

Figure 1A:
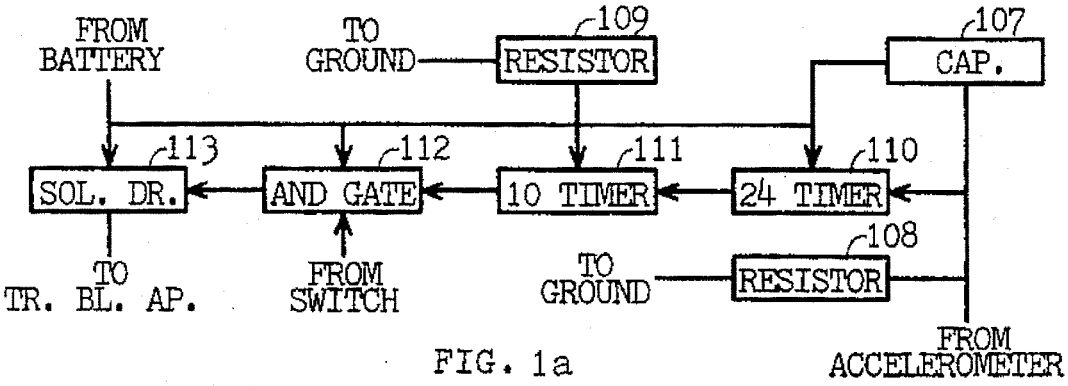
FIG. 1*a* illustrates an alternative to a part of the handgun of FIG. 1.

FIG. 1*a* illustrates a circuit that can be used as a discrete circuit alternative to the IC circuit of FIG. 1, except it will allow firing immediately after the 24 hour period. Firing immediately after the 24 hour period versus firing immediately after sensing an acceleration as in the IC circuit makes little difference since picking up the handgun 100 for firing will normally involve the sensing of accelerations. The discrete circuit is based on an accelerometer having a logic 1 level output when it senses acceleration. It consists of a capacitor 107, two resistors 108 and 109, a 24 hour timer 110, a ten minute timer 111, a two input AND gate 112, and a solenoid driver 113, e.g., a transistor. The power inputs of the gate 112, the timers 110, 111 and driver 113 are all connected to the battery 104. The 24 hour timer's trigger is connected to the accelerometer 101 and to an RC network formed by the capacitor 107 and resistors 108, 109 which are grounded. The output of the 10 minute timer 111 goes to one input of the AND gate 112 which has its other input connected to the switch 105. The output of the solenoid driver 113 is connected to the solenoid part of the trigger blocking apparatus 103. The 24 hour timer 110 can be an IC timer/counter capable of a 0 level output during timing, of being set to provide a 24 hour period, and of logic 1 level triggering and retriggering. The RC network has a capacitance which permits triggering by the battery 104 and resistances which allow for accelerometer triggering and retriggering and which discharge the capacitor 107 quickly enough for the timer to be triggered in the event that the battery 104 is connected, disconnected and then quickly reconnected. The 10 minute timer 111 can be an IC timer/counter capable of a 1 level output during timing, of being triggered and retriggered by a 1 level input and of being set to provide a 10 minute period. The 24 hour timer 110 is triggered by way of the RC network when the battery 104 is connected and retriggering by the battery 104 is prevented by the same network. Battery triggering prevents firing of the handgun 100 until the battery 104 has been connected for at least 24 hours. When the accelerometer 101 senses an acceleration, its 1 level output triggers or retriggers the 24 hour timer 110. This causes the timer's output to go to or stay at the 0 level for 24 hours. With no additional retriggering of the timer 110 for 24 hours, its output to the 10 minute timer 111 will go to the 1 level. This triggers and continues to retrigger the 10 minute timer until the 24 hour timer 110 is again triggered when the handgun 100 undergoes movement, e.g. when it is picked up. During timing by the ten minute timer 111, the timer's output will remain at the 1 level. If the switch 105 is closed during that time there will be 1 levels on both of the AND gate's inputs and the gate 112 will then have a 1 level output which will turn on the solenoid driver 113. This energizes the solenoid part of the trigger blocking apparatus which allows firing.

It is important that the handgun 100 has good resistance to tampering and circumvention. Such resistance is provided by welding shut the handgun 100 or providing it with a lockable and unlockable access part and by the use of a trigger blocking apparatus 103 that prevents firing if it does not receive power instead of one that prevents firing if it receives power which can be easily circumvented by removing the battery 104. In all of the other hand weapons described hereinafter having similar parts there is also the same resistance to tampering and circumvention offered by those parts.

In this application based on when referring to discharging, refers to a basic condition for preventing discharging. A basic condition can be expressed in other ways which essentially mean the same thing, e.g., in the case of this handgun 100, it could be stated that firing is not prevented or is allowed or enabled for 10 minutes based on the handgun 100 having been moved after remaining motionless for at least 24 hours, etc. In addition, variations in the actual prevention of firing are within the scope of the basic condition for preventing discharging, e.g., the amount of time, that firing is allowed after a certain event.

Many variations of this handgun 100 are possible, e.g., instead of using one acceleration of more than a certain strength as the criterion for determining that an act has occurred relating to changing the location of the handgun 100, it is possible to use 2 accelerations of more than another strength within a 1 minute period. It is also possible to use other sensors to sense a change of location of the handgun 100. For example, an attitude or geomagnetic sensor could be used. Or, since the approach of a person to the handgun 100 is also an act relating to changing the location of the handgun 100, a proximity detector could be used to sense the approach or contact of a person with the handgun 100. If a proximity detector is used to sense approaching, the sensing distance would be one that would not be approached within unless there was intent to touch the weapon, e.g., 2 cm. It is also within the scope of this invention to use other time periods for preventing and allowing firing.

Although it is possible to use other conditions, times, sensors, etc., those used are good choices. They reduce the portability of the handgun 100 for many crimes and make it useless for constant carrying as a concealed weapon, for most robberies and for getaways, hostage takings and shoot-outs lasting more than 10 minutes, while allowing it to be adequate for defense in homes and businesses.

Since the locations of most hand weapons used for defense in homes and businesses are not changed for long periods, the 24 hour requirement of this handgun 100 is not a great disadvantage for defensive use. And since most defense with hand weapons requires less than ten minutes and a person can have a backup weapon to use if more time is needed, there is no great disadvantage to the ten minute limit either.

Figure 3:
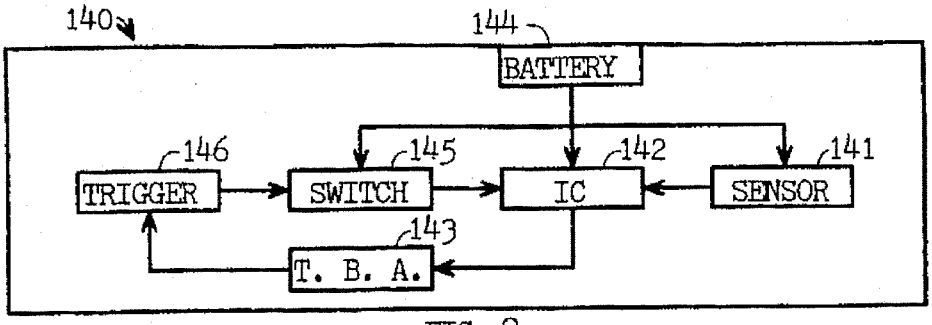
FIG. 3 is a block diagram of a handgun having electronic parts.
Figure 4:
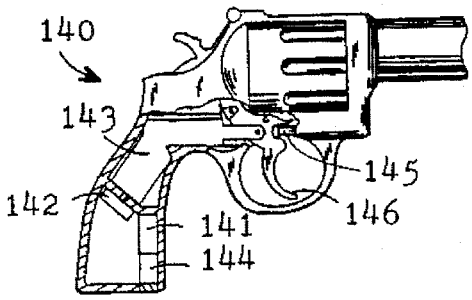
FIG. 4 further illustrates the parts of FIG. 3.

FIGS. 3 and 4 illustrate a handgun 140 having an attitude sensor 141 that senses a concealment attitude of the handgun 140, i.e. a line parallel to said weapon's width dimension forms an angle of less than 45 degrees with a horizontal plane.

A typical hand weapon is ordinarily best concealed on a person if a line parallel to the handgun's width dimension is parallel to a horizontal plane. The further that the line deviates from that position, the less concealable the hand weapon becomes.

When the attitude sensor 141 senses a concealment attitude of the handgun 140, it sends that information to an IC 142 which has timing and other circuitry. The IC 142 has an output that goes to a trigger blocking apparatus 143 which only permits firing when receiving power from the IC 142. A battery 144 constantly supplies power to the attitude sensor 141, the IC 142 and a normally open switch 145 which is controlled by the handgun's trigger 146.

The handgun 140 is designed for defensive use in homes, businesses and vehicles. Except for the electronic parts and the mechanical parts of the trigger blocking apparatus 143, it is essentially a revolver of conventional design.

Slightly pulling the trigger 146 for firing closes the switch 145. This sends power to a part of the IC 142 that allows the power to go to the trigger blocking apparatus 143 if there has been an at least 24 hour period during which the attitude sensor 141 did not sense that the handgun 140 was at a concealment attitude. This disables the trigger blocking apparatus 143 and allows firing of the handgun 140. If the handgun is then placed in a concealment attitude the IC begins timing a 10 minute period. Following the 10 minute period, the IC prevents power from going to the trigger blocking apparatus 143 which enables the apparatus 143 to again prevent firing. If the 24 hour condition for firing is not met, power will not be sent to the trigger blocking apparatus 143 and the apparatus 143 will prevent firing of the handgun.

Thus, in order for the handgun 140 to be fired, its attitude sensor 141 must not sense the handgun 140 being at a concealment attitude for an at least 24 hour period. After completing the minimum period, the handgun 140 can be fired for an unlimited amount of time as long as the angle does not go between 0 and 45 degrees. If this should happen, the handgun 140 will only be able to be fired during the immediately following 10 minute period. After the 10 minute limit for firing is over, the handgun 140 can no longer be fired until it again fulfills the conditions required for firing. In addition, since all of its electronic parts depend on adequate battery power for operation, the handgun 140 cannot be fired unless it has had a good battery 144 in it for at least 24 hours.

Figure 3A:
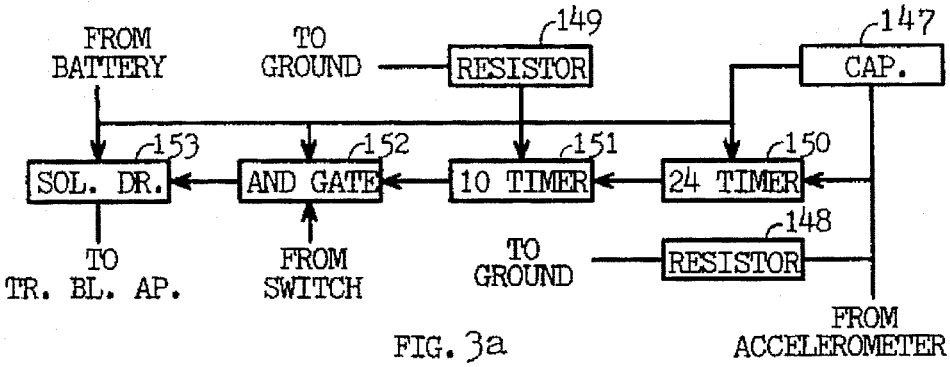
FIG. 3*a* illustrates an alternative to a part of the handgun of FIG. 3.

FIG. 3*a* illustrates a circuit that can be used as an alternative to the IC 142 of FIG. 3. It is based on an attitude sensor having a logic 1 level output when it senses a concealment attitude. It consists of a capacitor 147. Two resistors 148 and 149, a 24 hour timer 150, a ten minute timer 151, a two input AND gate 152, and a solenoid driver 153. The power inputs of the gate 152, the timers 150, 151 and driver 153 are all connected to the battery 144. The 24 hour timer's trigger is connected to the attitude sensor 141 and to an RC network formed by the capacitor 147 and resistors 148, 149 which are grounded. The output of the 10 minute timer 151 goes to one input of the two input AND 152 gate which has its other input connected to the switch 145. The output of the solenoid driver 153 goes to the solenoid part of the trigger blocking apparatus 143. The 24 hour timer 150 can be an IC timer/counter capable of a 0 level output during timing, of being set to provide a 24 hour period, and of logic 1 level triggering and retriggering. The RC network has a capacitance which permits triggering by the battery 144 and resistances which discharges the capacitor 147 quickly enough for the timer to be triggered in the event that the battery 144 is connected, disconnected and then quickly reconnected. The 10 minute timer 151 can be an IC timer/counter capable of a 1 level output during timing, of being triggered and retriggered by a 1 level input and of being set to provide a 10 minute period. The 24 hour timer 150 is triggered by way of the RC network when the battery 144 is connected and retriggering by the battery 144 is prevented by the same network. Battery triggering prevents firing of the handgun 140 until the battery 144 has been connected for at least 24 hours. When the attitude sensor 141 level senses a concealment attitude, its 1 level output triggers or retriggers the 24 hour timer 150. This causes the timer's output to go to or stay at the 0 level for 24 hours. If there is no additional retriggering of the timer 150 for 24 hours its output to the 10 minute timer will go to the 1 level. This triggers the 10 minute timer 151 and continues to retrigger it as long as the handgun 140 is not placed in a concealment attitude. During timing by the ten minute timer 151, its output will remain at the 1 level. If the switch 154 is closed during that time there will be 1 levels on both of the AND gate's inputs and the gate 152 will then have a 1 level output. This will turn on the solenoid driver 153 which will energize the solenoid part of the trigger blocking apparatus 143 to allow firing.

The electronic parts of this handgun 140 together with the mechanical parts of the trigger blocking apparatus 143 can be regarded as an apparatus for reducing the criminal usefulness of a hand weapon (in this case the weapon formed by the remaining parts of the handgun 140) comprising a means for sensing a certain attitude of the weapon, means for preventing the discharging of the weapon based on the sensing means sensing the attitude during a past certain period.

Although it is possible to use other conditions for preventing the firing of this handgun 140 (e.g. the angle may be formed by the weapon's length dimension and the horizon, with the range being between 50 and 90 degrees and with discharging being prevented if there has been more than 10 minutes of sensing the angle being within that range during the immediately preceding 24 hour period), etc., those used are good choices. They make it a poor choice for constant illegal carrying as a concealed weapon, and for many other crimes while allowing the handgun 140 to be adequate for defense in homes, businesses and vehicles.

Since most hand weapons used for defense in homes, businesses and vehicles lie on their sides for long periods until they are needed, the 24 hour requirement of this handgun 140 is not a great disadvantage for the average user. And since most defense with hand weapons requires less than ten minutes of use and unlimited firing time can be obtained by not putting the handgun 140 at an angle that can be sensed during use, there are no great disadvantages to the ten minute limit either.

Figure 5:
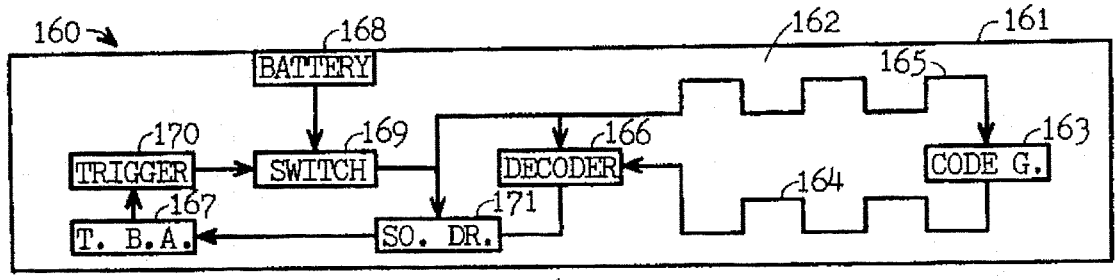
FIG. 5 is a block diagram of a shotgun having electronic parts.
Figure 6:
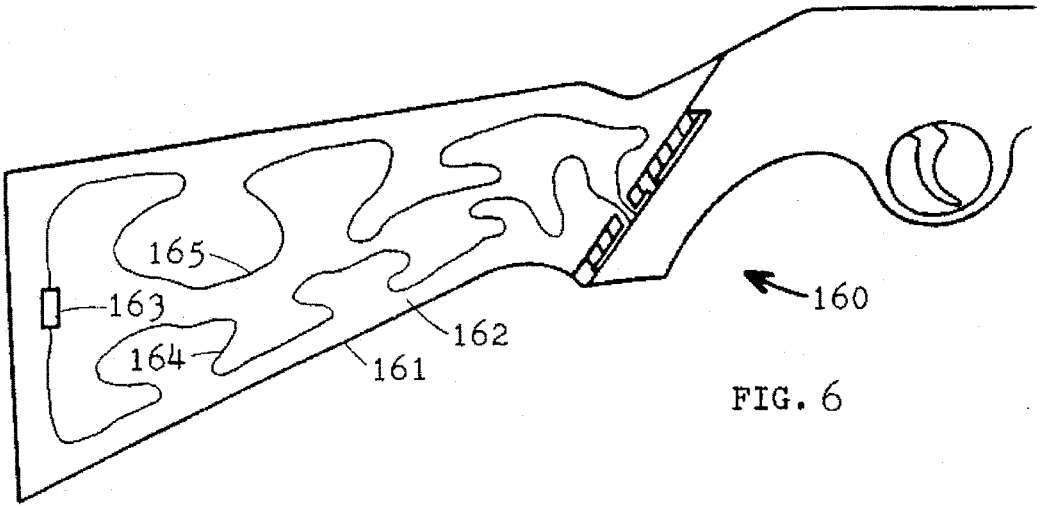
FIG. 6 further illustrates the parts of FIG. 5.

FIGS. 5 and 6 illustrate a shotgun 160 having a buttstock 161 of opaque epoxy 162 with a code generator 163, a 30 gage (AWG) thinly insulated signal wire 164, a power wire 165 and a ground wire (not illustrated) all 1 m long and winding without access through the epoxy 162. This construction makes it almost impossible to significantly reduce to size of the buttstock 161 or to tamper with the electronic parts embedded in it without damaging one or more of the parts.

The code generator 163, signal wire 164 and a decoder 166 are essential parts of a system for determining whether or not the buttstock 161 is intact and joined to the rest of the shotgun 160. The decoder 166 can be an IC decoder capable of decoding the signal generated by the code generator 163 and of turning on a solenoid driver 171 when it decodes that signal.

The output of the decoder 166 IC goes to the solenoid driver 171. The driver 171 is capable of driving the solenoid part of the trigger blocking apparatus 167 which prevents firing of the shotgun 160 when it is not being driven. A battery 168 is connected to a normally off switch 169 which is controlled by the trigger 170.

The buttstock 161 was formed by injecting freshly mixed opaque epoxy into a mold holding all the illustrated parts. Except for the electronic parts and the mechanical parts of the trigger blocking apparatus 167, the shotgun 160 is essentially a shotgun of conventional design.

Slightly pulling the trigger 170 for firing closes the switch 169. This sends power from the battery 168 through the power wire 165 to the decoder 166, to the solenoid driver 171 and to the code generator 163. The power causes the code generator 163 to generate a signal having a frequency based on a serial number assigned to the shotgun 160. The signal is coupled to the decoder 166 through the signal wire 164. The decoder decodes the signal which turns on the solenoid driver 171. This causes the driver 171 to send driving power to the solenoid part of the trigger blocking apparatus 167 which then allows firing.

If the buttstock 161 is cut down or completely removed, no signal will be received by the decoder 166. Consequently, it will not turn on the solenoid driver 171 to send power to the trigger blocking apparatus 167. With no power going to the trigger blocking apparatus 167, the apparatus 167 will block complete trigger movement and the shotgun 160 will not be able to be fired. Also, since no signal will be received by the decoder 166 if one of the electronic parts in the buttstock 161 has been damaged the shotgun 160 will not be able to be fired under that condition either.

It is important that the shotgun 160 has good resistance to tampering and circumvention. Such resistance is provided by welding shut the part housing the trigger blocking apparatus 167 or providing it with a lockable and unlockable access part, by the small diameter of the wires which makes them easy to cut or break and difficult to splice, by embedding and winding the wires in the epoxy 162 which makes it difficult to cut into the epoxy 162 without cutting at least one wire, by the use of a code system instead of a fairly nonspecific direct current which is easily obtained with batteries and by the use of a trigger blocking apparatus 167 that prevents firing if it does not receive power instead of one that prevents firing if it receives power which can be easily circumvented by removing the battery. In all of the other hand weapons described in this application having similar parts there is also the same resistance to tampering and circumvention offered by those parts.

All of the electronic parts of the shotgun 160 and the mechanical parts of the trigger blocking apparatus 167 can be regarded as an apparatus for reducing the criminal usefulness of a hand weapon (in this case the shotgun formed by the remaining parts of the shotgun 160) comprising a means for determining whether or not a part of the weapon not necessary for the discharging of the weapon has been disjoined from the weapon and a means for preventing the discharging of the weapon based on the part being disjoined from the weapon.

The electronics of this shotgun 160 deter the cutting down of the buttstock 161 to increase the concealability and/or portability of the shotgun 160 and the principle that is employed can be used to deter cutting down of other parts of this and other hand weapons. It is also possible to use other parts and systems to achieve the same purpose, e.g., a fiber optic system could be used instead of the signal wire 164 and associated system.

Figure 7:
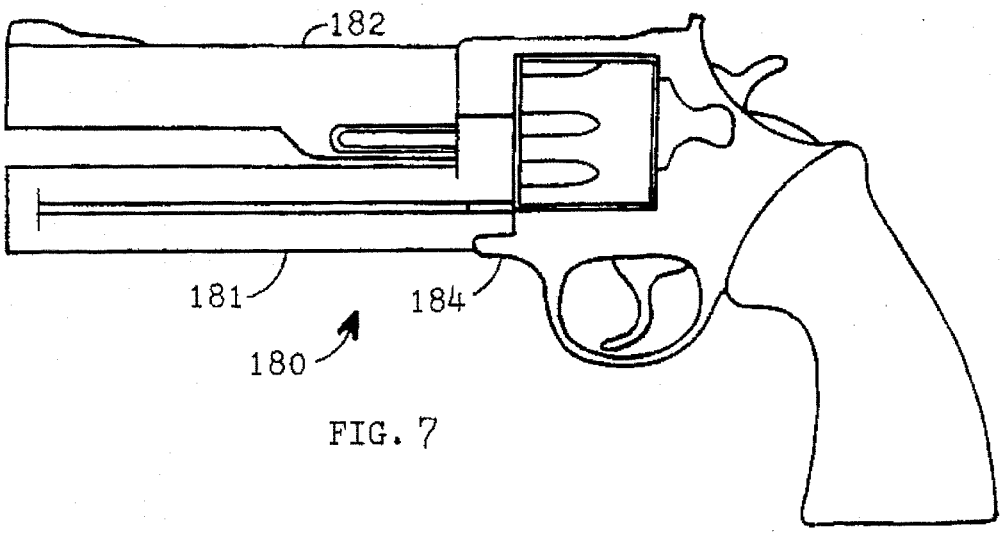
FIG. 7 illustrates a handgun having a forward projecting crane.

FIG. 7 illustrates a revolver 180 that is very similar to a 0.22 caliber Colt Trooper MK III except that it has a permanently magnetized Alnico XII (number 12) crane 181. The revolver 180 has a 15.24 cm barrel 182 and the operation of the revolver 180 is the same as that of the Trooper.

The crane 1181 extends forward 15.24 cm from the beginning of the barrel 182 which means the crane extends forward for the length of the barrel 182.

Figure 8:
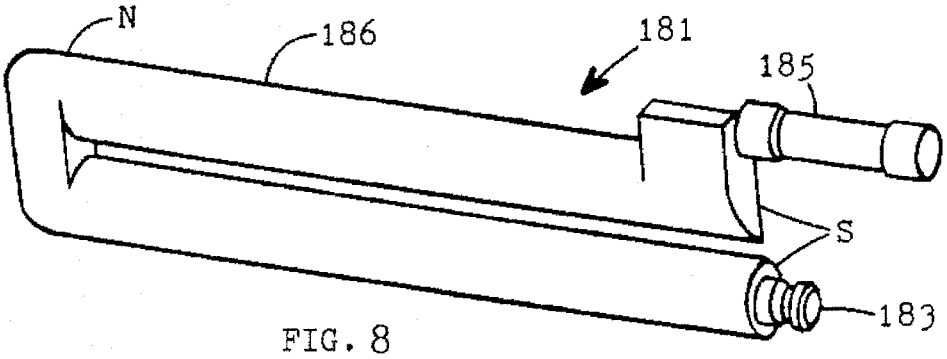
FIG. 8 further illustrates the crane of FIG. 7.

FIG. 8 illustrates that the crane 181 has a pivoting part 183 for joining the crane 181 to the frame 184, a cylinder supporting part 185 and a forward extending linking part 186. Like a Trooper crane, the illustrated crane 181, including the linking part 186, is necessary for the firing of the revolver 180, i.e., it holds the cylinder in place.

A Trooper having a 15.24 cm barrel is not easily concealed in light clothing. Its barrel, however, can be easily cut down to 5 cm to give the revolver 180 good concealability. On the other hand, with the illustrated revolver 180 there would be little to gain by cutting down its barrel 182 to 5 cm. Its crane 181 would still extend forward. This gives it reduced criminal usefulness compared to a Trooper. In addition, Alnico XII as well as the other Alnico alloys are hard and except for grinding, cannot be machined. Thus, it would be difficult to shorten the crane 181 and still have it operate properly.

N and S indicate magnetic polarity and that the polarity of the Alnico material is in the length dimension of the crane 181. The material provides a magnetic field in the vicinity of the revolver 180 that can be sensed by magnetic sensing devices. Such devices could be located in stores, banks, airline terminals, government offices, etc. to disclose the presence of a magnetized hand weapon concealed on a person or in baggage.

Although it is within the scope of this invention to use different materials, dimensions or shapes for the crane 181, the ones used are good choices. They reduce criminal usefulness of the revolver 180 but do not greatly affect its use or handling when it is used for most defensive purposes.

It is also possible to use the crane 181 on a Trooper having a longer barrel to deter cutting its barrel to less than 15.24 cm or with shorter barreled Trooper to decrease the concealability of the revolver.

Because the revolver 180 has reduced criminal usefulness, it may find acceptance for home, business and vehicle defense in areas where conventional handguns are greatly restricted or banned. In addition, if a state or community should ban conventional revolvers in favor of revolvers having cranes that extend forward and/or revolvers having magnetized parts necessary for the firing of the revolvers, the illustrated crane 181 and similar cranes could be used to modify the conventional revolvers already there so that those revolvers would not have to be sold nor thrown away. Modification would consist of removing a conventional crane and replacing it with the illustrated crane 181 or a similar crane.

Figure 9:
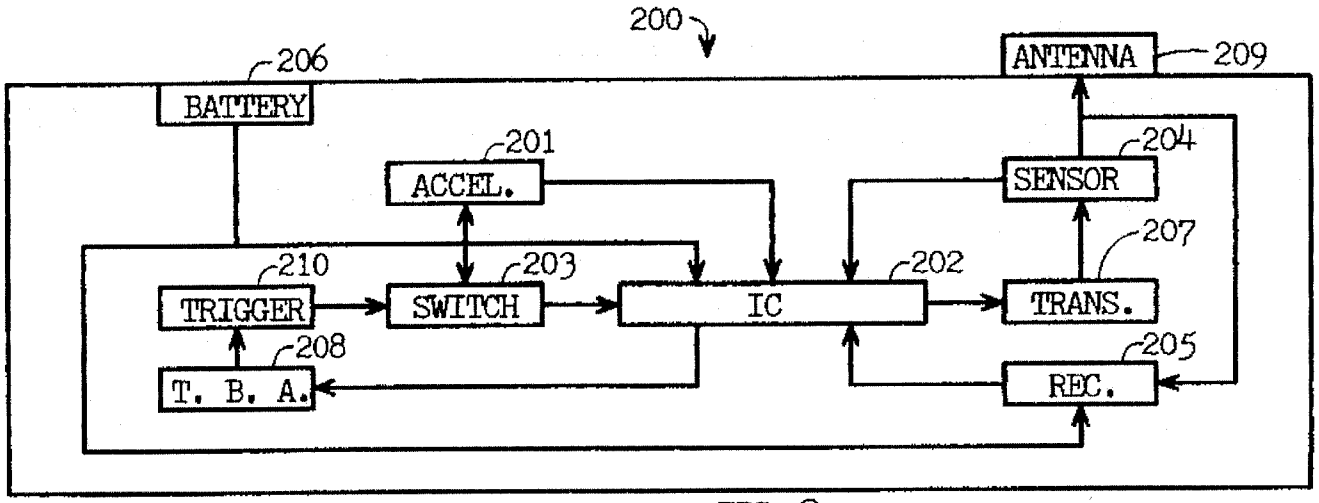
FIG. 9 is a block diagram of a handgun having electronic parts.
Figure 10:
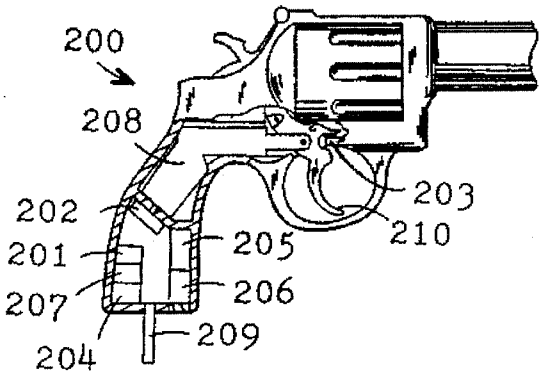

FIGS. 9 and 10 illustrate a handgun 200 having an accelerometer 201 that is capable of sensing the accelerations that occur when a person changes the location of the handgun 200, but is not capable of sensing accelerations from usual everyday environmental vibrations that occur while the handgun 200 is not being used, e.g., a capability of sensing more than 0.01 g at frequencies of less than 5 Hz.

When the accelerometer 201 senses acceleration of the handgun 200 as its location is changed by being picked up, carried, aimed, etc., it sends that information to an IC 202. The IC 202 has five inputs: one from the accelerometer 201, one from a normally open switch 203, one from an SWR sensor (standing wave ratio) 204, one from a radio receiver 205 and one from a battery 206. The IC 202 has two outputs: one to the transmitter 207 and one to a trigger blocking apparatus 208. The transmitter 207 output goes to the SWR sensor 204 and then on to an antenna 209, which also connects with the receiver 205. The battery 206 constantly supplies power to the accelerometer 201, the IC 202, the receiver 205 and the switch 203.

The handgun 200 is designed for defensive use at any location. Except for its electronic parts and the mechanical parts of the trigger blocking apparatus 208, it is essentially a revolver of conventional design.

The switch 203 is controlled by the trigger 210 and slightly pulling the trigger 210 for firing closes the switch 203. This sends power to a part of the IC 202 that causes it to turn on the transmitter 207 to transmit a sine wave radio signal based on a serial number assigned to the handgun 200. Whenever the signal is transmitted, the SWR sensor 204 senses the standing wave ratio of the antenna 209 and wiring that the receiver 205 and transmitter 207 share. In cases where the antenna 209 or wiring has been cut, the antenna 209 shielded or other transmitting parts tampered with, the SWR will be abnormal.

The SWR sensor 204 sends information about the SWR to the IC 202. If the SWR is normal, the IC 202 will send power to the trigger blocking apparatus 208 which allows firing. If the SWR is abnormal the IC 202 will not send power to the trigger blocking apparatus 208 for at least 24 hours and the handgun 200 will not be able to be fired during that time. This prevents a person from tampering with or shielding the antenna 209 to restrict the transmitting of the signal and/or reducing the receiving abilities of the handgun 200. Also, the IC 202 will not send any power to the trigger blocking apparatus 208 unless the battery 206 has been connected without interruption for at least 24 hours.

The IC 202 also turns on the transmitter 207 to transmit the signal under three other conditions: at random times on the average of once every hour, at random times on the average of once every five minutes during the first hour following the accelerometer 201 sensing a change of position of the handgun 200 and whenever the receiver 205 receives an interrogating signal.

An interrogating signal can be transmitted by an electronic system located in a store, bank, airport, high crime area or other place where it is desirable to prohibit unauthorized hand weapons having the receiving and transmitting abilities of this handgun 200. Such a system would have a transmitter for transmitting an interrogating signal, a receiver for receiving a signal from the weapon and an alarm or other device to indicate that a weapon is in the vicinity. It could also have a device for recording the serial number of the weapon.

Figure 9A:
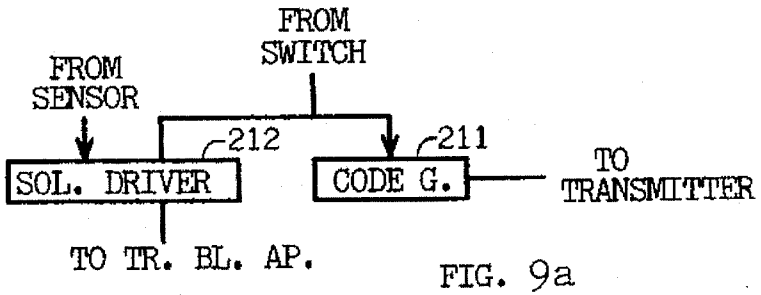
FIG. 9*a* illustrates an alternative to a part of the handgun of FIG. 9.

FIG. 9*a* illustrates a circuit that can be used as an alternative to the IC 202 of FIG. 9 if only transmitting when firing is desired. It is based on a SWR sensor having an output capable of turning on a solenoid driver when it senses a normal SWR. It consists of a code generator 211 and a solenoid driver 212. The code generator 211 is connected to the switch 203 and its output goes to the transmitter 207. The solenoid driver 212 has its power input connected to the switch 203, its controlling input connected to the output of the SWR sensor 204 and its output connected to the solenoid part of the trigger blocking apparatus 208. The code generator 211 can be an IC capable of generating a signal having a frequency based on the serial number assigned to the handgun 200. Closing the switch 203 for firing turns on the code generator 211 and the transmitter 207 transmits the generator's 211 signal by way of the SWR sensor 204. If the sensor 204 senses a normal SWR it turns on the solenoid driver 212 which energizes the solenoid part of the trigger blocking apparatus 208 to allow firing.

The electronic parts of this handgun 200 together with the mechanical parts of the trigger blocking apparatus 208 can be regarded as an apparatus for reducing the criminal usefulness of a hand weapon (in this case the weapon formed by the remaining parts of the handgun 200) comprising a means for transmitting a signal and a means for preventing the discharging of the weapon based on the transmitting means being restricted in the transmitting of the signal.

Although, it is possible to use other types of signals (e.g., infrared or sound waves), times, sensors (e.g., an attitude sensor), etc., those used are good choices. They make the handgun 200 useless for concealed carrying in the in a location having a system for receiving the signals from the handgun 200. The handgun 200 can also by detected when it is not being carried, however its ability to be detected is not a disadvantage for most defensive uses.

Figure 11:
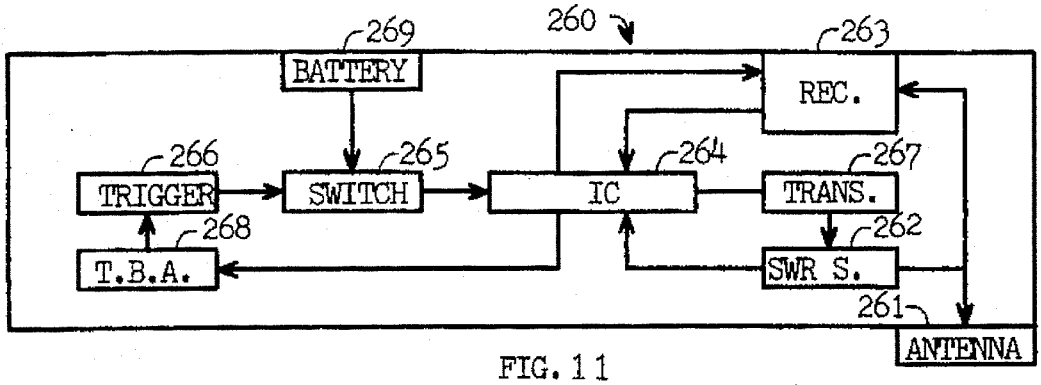
FIG. 11 is a block diagram of a handgun having electronic parts.
Figure 12:
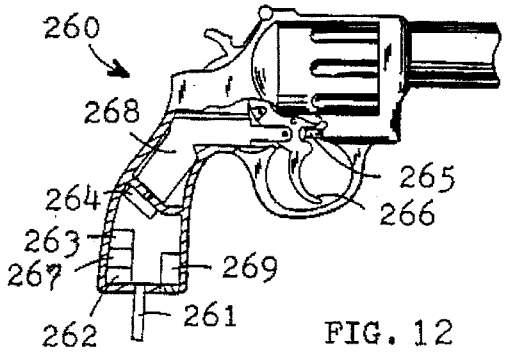
FIG. 12 further illustrates the handgun of FIG. 11.

FIGS. 11 and 12 illustrate a handgun 260 having an antenna 261 connected to an SWR sensor 262 and a radio receiver 263. The output of the receiver 263 goes to an IC 264. The IC 264 has inputs from the receiver 263, the SWR sensor 262 and a normally open switch 265 which is controlled by the handgun's trigger 266. The IC 264 has three outputs: one to the receiver 263, one to a radio transmitter 267 and one to a trigger blocking apparatus 268. A battery 269 supplies power to the switch 265. Except for its electronic parts and the mechanical parts of the trigger blocking apparatus 268, the handgun 260 is essentially a revolver of conventional design.

Slightly pulling the trigger 266 for firing closes the switch 265. This supplies power to the IC 264 and causes it to turn on the receiver 263 for 0.5 milliseconds. The receiver 263 is made to receive unmodulated radio signals that must have a certain frequency and a signal strength of more than 0.01 watts per square meter.

During the 0.5 millisecond period, the receiver 263 sends an output to the IC 264 if any signal is received. After the period, the IC 264 turns on the transmitter 267 to transmit a signal modulated with a frequency based on a serial number assigned to the handgun 260. This signal goes through the SWR sensor 262 and is transmitted by the antenna 261.

The output of the SWR sensor 262 goes to the IC 264. The output reflects whether or not the receiver 263 is being restricted in the receiving of the signal. This is important for the handgun 260. The receiver 263 and the transmitter 267 share the same antenna 261 and also some other wiring. Attempts to circumvent the handgun's operation by shielding of tampering with the antenna 261 or wiring to restrict the receiving of the signal is sensed as an abnormal SWR by the SWR sensor 262 when the signal is transmitted. If, when the trigger 266 is pulled, the SWR is determined to be abnormal, the IC 264 will not send any power to the trigger blocking apparatus 268.

If a signal is not received by the receiver 263 and the value of the SWR is normal, the IC 264 will send power to the trigger blocking apparatus 268 which will allow the handgun 260 to be fired.

If, when the trigger 266 is pulled, a signal is received by the receiver 263 and the SWR is normal, the IC 264 will turn on the receiver 263 again for 0.5 milliseconds immediately after it has sent the code signal. If, during the 0.5 milliseconds, the receiver 263 receives an uninterrupted signal, the IC 264 will not send any power to the trigger blocking apparatus 268. On the other hand, if the signal is interrupted for 0.1 millisecond during the 0.5 millisecond period, the IC 264 will send power to the trigger blocking apparatus 268 which will allow the handgun 260 to be fired.

Figure 13:
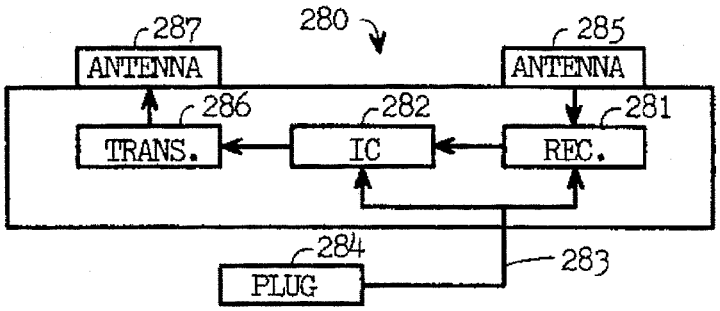
FIG. 13 is a block diagram of an apparatus for preventing the firing of handguns similar or the handgun of FIGS. 11 and 12.
Figure 14:
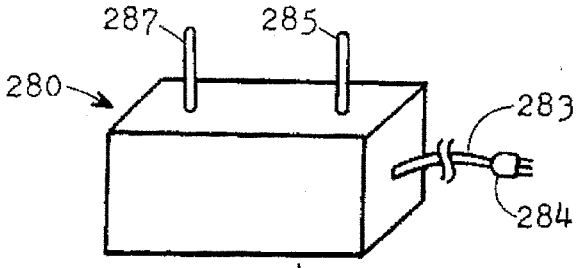
FIG. 14 further illustrates the apparatus of FIG. 13.

Interrupted and uninterrupted signals can be transmitted from antifiring system 280 such as the one illustrated by FIGS. 13 and 14. This particular system 280 can prevent or allow the discharging of weapons having electronic parts similar to those of the illustrated handgun 260. The ability of this and similar systems to prevent firing makes it possible to place such systems in locations susceptible to robberies so that this handgun 260 would be useless for robberies at those locations. This would only affect its operation at such locations and it could be used at all other locations without any limitations.

Power is supplied to a receiver 281 and an IC 282 by means of an electric cord 283 and a plug 284 that plugs into a suitable source of power. The receiver 281 has an antenna 285 and the receiver's output goes to the IC 282. The IC 282 controls the power going to a transmitter 286 which has its own antenna 287. The transmitter 286 continuously transmits a signal that a weapon's receiver 281 is capable of receiving if the antifiring system 280 is within about 20 m of the weapon. This is because the signal strength of the signal is less than 0.01 watts at distances greater than about 20 m from the transmitter 286.

The handgun 260 can be used in any location not protected by an antifiring system that is not matched to the handgun 260. The illustrated antifiring system 280 will not prevent the firing of the illustrated handgun 260 at any time because it is matched with the handgun 260. The antifiring system 280 can be used in conjunction with the illustrated handgun 260 to prevent the discharging of susceptible weapons carried by criminals without affecting the firing of the illustrated handgun 260. When the system's receiver 281 receives the signal of the handgun's serial number that is transmitted by the handgun's transmitter 267 it decodes the signal and sends the information to the system's IC 282. The IC 282 is programmed to respond to the serial number by turning off the transmitter 286 for 0.1 millisecond. It is this interrupted signal that causes the handgun's IC 264 to send power to the trigger blocking apparatus 268. In the case of weapons not matched with the antifiring system 280, the system's IC 282 will not interrupt the signal and the consequently the weapon will not be able to be fired as long as it is within about 20 m of the system 280.

The frequencies used by the handgun 260 and systems 280 are critical only in that the system's receiver 281 has a very narrow bandwidth and it and the handgun's transmitter 267 operate at a frequency 1 kilohertz away from the handgun's receiver 263 and the system's transmitter 286.

This assures better reception of the code signal since the system's transmitter 286 is much stronger than the handgun's transmitter 267.

The 0.01 watts per square meter signal strength requirement was chosen to make it difficult for a criminal to carry around an antifiring system to prevent being fired at. The capability of transmitting a signal of that strength at practical distances requires an antifiring system of a size and weight that is unsuitable for concealed carrying. However, size and weight are not very important for a fixed location such as a place of business or for carrying unconcealed to a location such as a shootout.

Figure 11A:
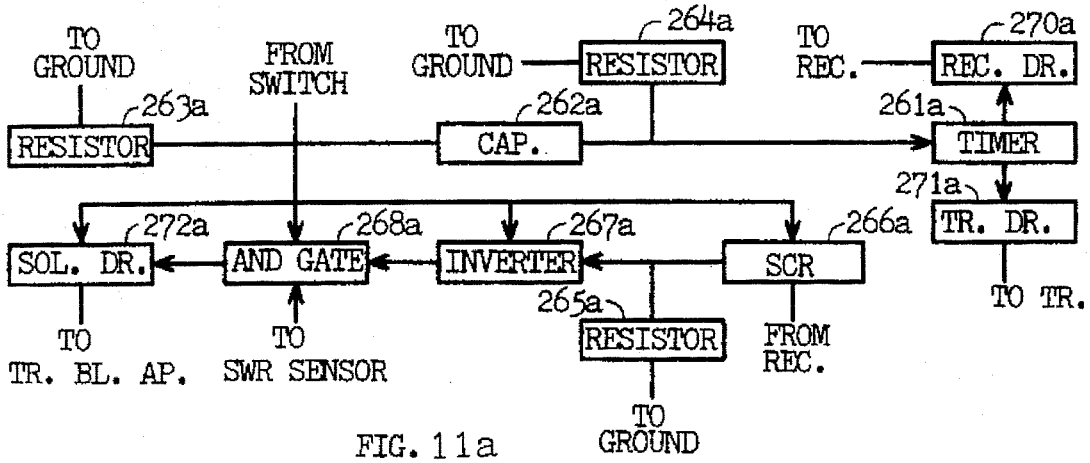
FIG. 11*a* illustrates an alternative to a part of the handgun of FIG. 11.

FIG. 11*a* illustrates a circuit that can be used as an alternative to the IC 264 of FIG. 11 if only preventing firing of the handgun 260 based on receiving the signal and on the receiver 263 being restricted in the receiving of the signal is desired. It consists of a timer 261*a*, a capacitor 262*a*, three resistors 263*a*, 264*a* and 265*a*, an SCR 266*a*, an inverter 267*a*, a two input AND gate 268*a*, a receiver driver 270*a*, a transmitter driver 271*a*, and a solenoid driver 272*a*. The switch 265 is connected to the power input of the timer 261a and to an RC network formed by the capacitor 262*a* and two of the resistors 263*a*, 264*a*. The output of the transmitter driver 271*a* goes to the power input of the receiver 263, and the output of the transmitter driver 271*a* goes to the power input of the transmitter 267. The anode of the SCR 266*a* is connected to the switch 265 and its gate is connected to the output of the receiver 263. The output of the SWR sensor 262 is connected to one input of the AND gate 268*a*. The output of the solenoid driver 272*a* goes to the solenoid part of the trigger blocking apparatus 268. The timer 261*a* can be an IC timer having two complementary outputs, logic 1 level triggering and the capability of being set to provide a time period having a length suitable for turning on the receiver 263 and obtaining a useful output. The RC network has a capacitance which permits triggering by the battery power being switched on and resistances which discharge the capacitor 262*a* quickly enough for the timer 261*a* to be triggered again and again during rapid firing. The SCR 266*a* must have the capability of being triggered by the output of the receiver 263, the resistor 265*a* connected to the SCR cathode has a value that allows for proper operation of the SCR 266*a* and inverter 267*a* and the transmitter 267 must be capable of being set to a frequency 1 kilohertz away from the frequency that the receiver 263 is tuned to and transmitting a signal modulated by a frequency based on a serial number assigned to the handgun 260. Closing the switch 265 for firing turns on and triggers the timer 261*a* which turns on the receiver 263 by way of the timer's normally off output and the receiver driver 270*a*. The reception of a signal by the receiver 263 results in the SCR 266*a* being triggered and a 1 level being applied to the inverter 267*a*. The output of the inverter 267*a* will then be a 0 level applied to one input of the gate 268*a* until the switch 265 is opened. If no signal is received, a 1 level will be applied to the gate 268*a* until the switch 266 is opened. After the timing period, the timer's output to the receiver driver 270*a* goes to the 0 level and its normally on output to the transmitter driver 271*a* goes to the 1 level. This turns on the transmitter driver 271*a* which turns on the transmitter 267. A signal is then transmitted by way of the SWR sensor 262. If the sensor 262 senses a normal SWR, a 1 level is applied to the remaining input of the AND gate 268*a*. If not, a 0 level is applied to the input. Only logic 1 levels on both of the gate's inputs turn on the solenoid driver 272*a* to energize the solenoid part of the trigger blocking apparatus 268 and allow firing.

The electronic parts of this handgun 260 together with the mechanical parts of the trigger blocking apparatus 268 can be regarded as an apparatus for reducing the criminal usefulness of a hand weapon (in this case the weapon formed by the remaining parts of the handgun 260) comprising a means for receiving a signal and a means for preventing the discharging of the weapon based on the receiving means receiving the signal and on the receiving means being restricted in receiving the signal.

It is possible to use a light or acoustic signal in a manner similar to the way a radio signal is used with this handgun 260. It is also possible to use other parts to yield a different distance from an antifiring system that the handgun 260 may be fired within, however the parts chosen are good choices. They make the handgun 260 useless for robberies in protected locations while not affecting its use in other locations.

Figure 15:
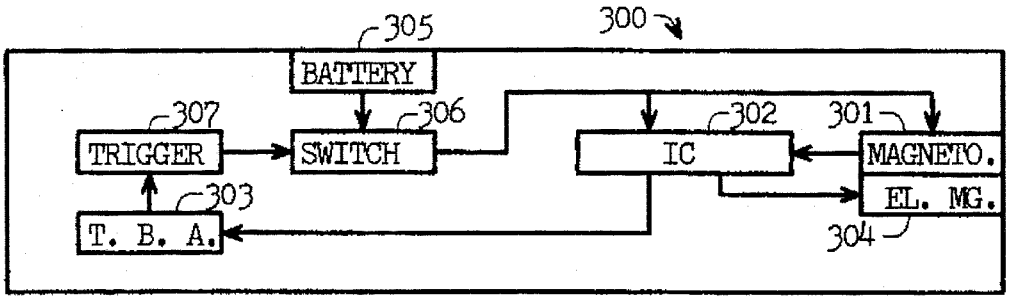
FIG. 15 is a block diagram of a handgun having electronic parts.
Figure 16:
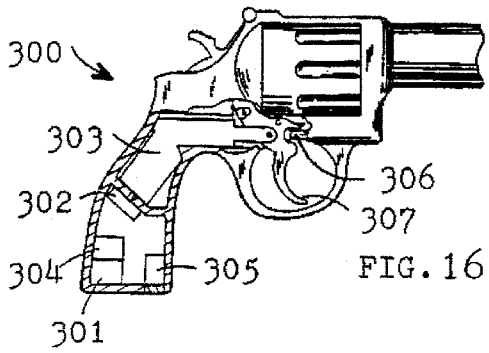
FIG. 16 further illustrates the handgun of FIG. 15.

FIGS. 15 and 16 illustrate a handgun 300 having a magnetometer 301 that senses the density of magnetic flux surrounding the handgun 300. It is located in the in the handle of the handgun 300 which is made of a nonferromagnetic material to prevent interference with magnetic sensing. The output of the magnetometer 301 goes an IC 302. The IC 302 has two outputs: one goes to a trigger blocking apparatus 303 and the other goes to an electromagnet 304 which is located close to the magnetometer 301. A battery 305 supplies power to a normally off switch 306 which is controlled by the trigger 307. The output of the switch 306 goes to the magnetometer 301 and IC 302.

Except for its electronic parts and the mechanical parts of its trigger blocking apparatus 303 the handgun 300 is essentially a revolver of conventional design.

Slightly pulling the trigger 307 for firing closes the switch 306 which sends power to the magnetometer 301 and the IC 302. This causes the magnetometer 301 to sense the magnetic flux density surrounding the handgun 300 and then send that information to the IC 302. The magnetic flux density produced by the earth is about 0.5 gauss and if the magnetometer 301 senses a normal magnetic flux density (less than 1 gauss), the IC 302 sends a pulse of power to the electromagnet 304. This is important for the handgun 300. It is done to determine whether or not the sensing ability of the magnetometer 301 is being restricted. The power causes the electromagnet 304 to produce a brief magnetic field of 1.5 gauss at the location of the magnetometer 301.

The magnetometer 301 senses the field and sends information about the field to the IC 302. Attempts to circumvent the handgun's operation by shielding or tampering with the magnetometer 301 is sensed as an abnormal flux density by the magnetometer 301 when the electromagnet 304 is energized.

If the magnetometer 301 output is normal, the IC 302 will send power to the trigger blocking apparatus 303 which allows firing of the handgun 300. If the information is abnormal, no power will be sent to the trigger blocking apparatus 303 and the handgun 300 will not be able to be fired. This prevents a person from tampering with or shielding the magnetometer 301 to restrict the sensing of magnetic flux density. Thus, in order to be fired, the magnetic flux density surrounding the handgun 300 must not be more than 1 gauss and the magnetometer must be unshielded and working properly.

Figure 15A:
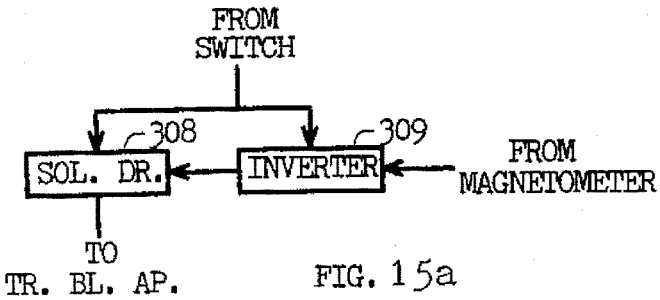
FIG. 15*a* illustrates an alternative to a part of the handgun of FIG. 15.

FIG. 15*a* illustrates a circuit that can be used as an alternative to the IC 302 of FIG. 15 if only preventing firing of the handgun 300 based on the magnetic flux density surrounding the handgun 300 being more than a certain amount is desired. It is based on a magnetometer having a 1 level output when it senses a magnetic flux density of more than 1 gauss. It consists of a solenoid driver 308 and an inverter 309. The power inputs of the solenoid driver 308 and inverter 309 are connected to the switch 306, the control input to the inverter 309 is connected to the magnetometer 301 and the output of the solenoid driver 308 is connected to the solenoid part of the trigger blocking apparatus 303. Closing the switch 306 for firing sends power to the solenoid driver 308, inverter 309 and magnetometer 301. If the magnetometer 301 senses a magnetic flux density of more than 1 gauss, its logic 1 level output going to the inverter 309 results in a 0 output applied to the solenoid driver 308 which does not turn on the driver 308. If the magnetometer 301 does not sense a flux density of more than 1 gauss its output of a 0 level results in an inverter output 1 level which turns on the solenoid driver 308. This energizes the solenoid which allows firing.

The electronic parts of this handgun 300 together with the mechanical parts of the trigger blocking apparatus 303 can be regarded as an apparatus for reducing the criminal usefulness of a hand weapon (in this case the weapon formed by the remaining parts of the handgun 300) comprising a means for sensing magnetic flux density surrounding the weapon and means for preventing the discharging of the weapon based on the flux density being more than a certain amount.

The inability to fire this handgun 300 in locations having a magnetic flux density of more than 1 gauss makes it possible to place permanent magnets or electromagnets in locations susceptible to robberies so that this handgun 300 would be useless for robberies at those locations. This would only affect its operation at such locations and it could be used at all other locations without any limitations.

While the above description contains many specificities, these should not be construed as limitations on the scope of the invention, but rather as exemplifications of the preferred embodiments thereof. Many variations are possible without departing from the scope of the invention as defined in the appended claims and their legal equivalents.

I claim:

1. A method for reducing the criminal usefulness of a dischargeable hand weapon comprising:

preventing the discharging of said weapon;

determining that said weapon was not at a certain attitude during a certain period of time;

allowing the discharging of said weapon;

determining that said weapon was placed at a certain attitude during a certain period of time; and preventing the discharging of said weapon following a certain period of time after said second determining step.

2. A method as claimed in claim 1 wherein each of said determining steps comprises sensing whether or not said weapon is at an attitude such that a line parallel to said weapon's width dimension forms an angle of less than 45 degrees with a horizontal plane.

3. A method as claimed in claim 1 wherein said first determining step determines that said weapon was not at a certain attitude during a period of time that lasted a minimum of 12 hours, wherein said second determining step determines that said weapon was placed at said attitude during a period of time that began after said first determining step, and wherein said second preventing step prevents discharging following a period of time that lasts a maximum of 30 minutes after said second determining step.

4. A method as claimed in claim 1 wherein said first preventing step comprises:

providing discharge preventing means for preventing the discharging of said weapon;

providing access preventing means for preventing said discharge preventing means from being accessed without causing damage to a part of an assembly comprising said weapon, said discharge preventing means, and said access preventing means; and assembling said weapon, said preventing means, and said access preventing means into said assembly.

5. A method as claimed in claim 1 wherein said first preventing step comprises:

providing discharge preventing means for preventing the discharging of said weapon;

providing lockable and unlockable enclosing means for enclosing said preventing means in an assembly comprising said weapon, said preventing means, and said enclosing means;

assembling said weapon, said preventing means, and said enclosing means into said assembly; and locking said enclosing means.

6. An apparatus for a dischargeable hand weapon comprising:

means for sensing a certain attitude of said weapon;

means, in contact with said weapon, for preventing the discharging of said weapon;

means, in contact with said sensing means and said preventing means, for disabling said preventing means based on said sensing means not sensing said attitude during a certain past period of time; and means, in contact with said sensing means and said preventing means, for enabling said preventing means based on said sensing means sensing said attitude at a certain past time.

7. An apparatus as claimed in claim 6 wherein said sensing means comprises means for sensing whether or not said weapon is at an attitude such that a line parallel to said weapon's width dimension forms an angle of less than 45 degrees with a horizontal plane.

8. An apparatus as claimed in claim 6 wherein said disabling means comprises means for timing a certain period of time that lasts for a minimum of 12 hours, wherein said enabling means comprises means for timing a certain period of time that lasts for a maximum of 30 minutes, wherein said disabling means is for disabling said preventing means based on said sensing means not sensing said attitude during said minimum of 12 hours period, and wherein said enabling means is for enabling said preventing means following said maximum of 30 minutes period based on said sensing means sensing said attitude while said disabling means is disabling said preventing means.

9. An apparatus as claimed in claim 1 further comprising means, in contact with said weapon, for enclosing said preventing means in an assembly comprising said weapon, said preventing means and said enclosing means, so that said preventing means cannot be accessed without causing damage to a part of said assembly.

* * * * *